US007262787B2

(12) United States Patent
Park

(10) Patent No.: US 7,262,787 B2
(45) Date of Patent: Aug. 28, 2007

(54) LASER SCANNING UNIT ASSEMBLY AND LASER PRINTER HAVING THE SAME

(75) Inventor: Geun-yong Park, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 344 days.

(21) Appl. No.: 10/659,431

(22) Filed: Sep. 11, 2003

(65) Prior Publication Data

US 2004/0051923 A1 Mar. 18, 2004

(30) Foreign Application Priority Data

Sep. 18, 2002 (KR) ..... 10-2002-0057013
Feb. 17, 2003 (KR) ..... 10-2003-0009905

(51) Int. Cl.
*B41J 2/435* (2006.01)

(52) U.S. Cl. ..... 347/263

(58) Field of Classification Search ..... 347/152, 347/263, 229, 233–234, 241–245, 248, 256–258, 347/115–116, 138; 235/462.43
See application file for complete search history.

(56) References Cited

U.S. PATENT DOCUMENTS 4,297,713 A * 10/1981 Ichikawa et al. ..... 347/257
5,478,998 A * 12/1995 Charych et al. ..... 235/462.43
6,046,759 A * 4/2000 Kim ..... 347/263
6,278,471 B1 * 8/2001 Uchiyama et al. ..... 347/138
6,600,504 B2 * 7/2003 Okugawa et al. ..... 347/152
2004/0100547 A1 * 5/2004 Hattori ..... 347/115

FOREIGN PATENT DOCUMENTS

JP 06127020 A * 5/1994

* cited by examiner

*Primary Examiner*—Hai Pham
(74) *Attorney, Agent, or Firm*—Staas & Halsey LLP

(57) ABSTRACT

In a laser printer using a plurality of laser scan units, a laser scan unit is capable of manually adjusting a plurality of laser beams to be parallel. The laser scan unit assembly includes a laser scan unit having a window on a front surface through which a laser beam is emitted, a hinge portion provided at one side of the laser scan unit to pivotably dispose the laser scan unit on the body, and an adjusting portion provided on the side of the laser scan unit opposite from the hinge portion, to adjust an amount the laser scan unit pivots. The body has a hinge supporting portion provided thereon to support rotation of the hinge portion. The hinge portion is formed as a hinge shaft and the hinge supporting portion is formed as a groove to support the hinge shaft. The adjusting portion includes a first adjusting unit which is an inclined surface, and a second adjusting unit which is a screw and is provided on the body.

29 Claims, 5 Drawing Sheets

LASER SCANNING UNIT ASSEMBLY AND LASER PRINTER HAVING THE SAME

CROSS-REFERENCE TO RELATED APPLICATIONS

This application claims the priority of Korean Patent Application No. 2002-57013, filed Sep. 18, 2002 and Korean Patent Application No. 2003-9905, filed Feb. 17, 2003 in the Korean Intellectual Property Office, the disclosures of which are incorporated herein by reference.

BACKGROUND OF THE INVENTION

1. Field of the Invention

The present invention relates to a laser printer forming an image by scanning a plurality of laser beams, and more particularly, to a laser scan unit assembly capable of adjusting the plurality of laser beams from a plurality of laser scan units to be parallel with each other when scanned onto a photosensitive body, and a laser printer having the same.

2. Description of the Related Art

Generally, a laser printer prints a predetermined image by forming the image on a photosensitive body using laser beams emitted from a laser scan unit, and then transferring the image onto paper. A particular type laser printer such as a color laser printer forms an electrostatic latent image on the photosensitive body by emitting a plurality of laser beams from a plurality of laser scan units. Since the plurality of laser scan units are disposed at predetermined intervals to be parallel with each other, the laser beams emitted from the laser scan units are formed on the photosensitive body at predetermined intervals in parallel and create an electrostatic latent image. The laser printer then develops the electrostatic latent image created on the photosensitive body with a developing agent and transfers the developed image onto paper.

In such a laser printer, laser beams emitted from the laser scan units may not be parallel to each other due to manufacturing tolerances of the parts or assembling error. If the plurality of laser beams are not parallel, each color may be mis-positioned, thereby impairing print quality.

In order to solve such a problem, conventionally, a laser scan unit assembly adjusts the plurality of laser beams by adjusting angles of the mirrors reflecting the laser beams. Since a mirror unit has a laser scan unit inside, a motor is provided to adjust the angle of the mirror. The laser beams are formed on the photosensitive body in parallel with each other by adjusting the angle of the mirrors with a control unit controlling the motor.

However, problems occur when adjusting mirrors using a motor. First, the interior temperature of the laser scan unit increases as the temperature of the motor increases when used for a long time, and therefore the life span of the laser scan unit is reduced. Second, manufacturing costs are increased because the motors and the motor control units are required. Finally, space to dispose the additional motor is required, thereby enlarging the size of the laser printer. Therefore, there has been a need for a laser scan unit assembly capable of adjusting a plurality of laser beams on a photosensitive body without having to use a motor.

SUMMARY OF THE INVENTION

Accordingly, it is an aspect of the present invention to solve the above problems and/or disadvantages and to provide at least the advantages described hereinafter.

It is another aspect of the present invention to provide a scan unit assembly capable of manually adjusting a plurality of laser beams emitted from a plurality of laser scan units and formed on a photosensitive body to be parallel with each other.

It is still another aspect of the present invention to provide a laser printer having a laser scan unit assembly capable of manually adjusting a plurality of laser beams formed on a photosensitive body to be parallel with each other.

Additional aspects and/or advantages of the invention will be set forth in part in the description which follows and, in part, will be obvious from the description, or may be learned by practice of the invention.

The foregoing and/or other objects and advantages are realized by providing a laser scan unit assembly disposed in a printer body, including a laser scan unit having a window on a front surface thereof through which a laser beam is emitted; a hinge portion provided at a first side of the laser scan unit to pivotably dispose the laser scan unit on the body; and an adjusting portion on a second side of the laser scan unit opposite to the first side to adjust an amount the laser scan unit pivots. The body has a hinge supporting portion provided thereon to support rotation of the hinge portion.

The hinge portion is formed as a hinge shaft and the hinge supporting portion is formed as a groove to support the hinge shaft. In addition, the hinge supporting portion further includes a resilient member to press the hinge shaft against the groove.

The hinge portion is formed as a groove and the hinge supporting portion is formed as a hinge shaft to support the groove.

In addition, the adjusting portion includes a first adjusting unit provided on the opposite side of the laser scan unit and a second adjusting unit provided on the body. The first adjusting unit is an inclined surface and the second adjusting unit is a screw or alternatively the first adjusting unit is a screw and the second adjusting unit is an inclined surface. A guiding ring is further assembled at an end portion of the screw which is in contact with the inclined surface. In addition, the adjusting portion further includes a pressing unit to press the first adjusting unit against the second adjusting unit.

The foregoing and/or other aspect of the present invention may also be achieved by providing a laser scan unit assembly disposed in a printer body, including a laser scan unit having a window on a front surface thereof through which a laser beam is emitted; a hinge portion provided at a first side of the laser scan unit to pivotably dispose the laser scan unit on the printer body; and an adjusting portion on a second side of the laser scan unit opposite to the first side to adjust an amount the laser scan unit pivots.

According to the laser scan unit of the embodiments of the present invention, a plurality of laser beams emitted from a plurality of laser scan units can be manually adjusted to be formed on a photosensitive body in parallel. Furthermore, a laser scan unit including a laser scan unit assembly capable of manually adjusting a plurality of laser beams to be formed on a photosensitive body in parallel is provided.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
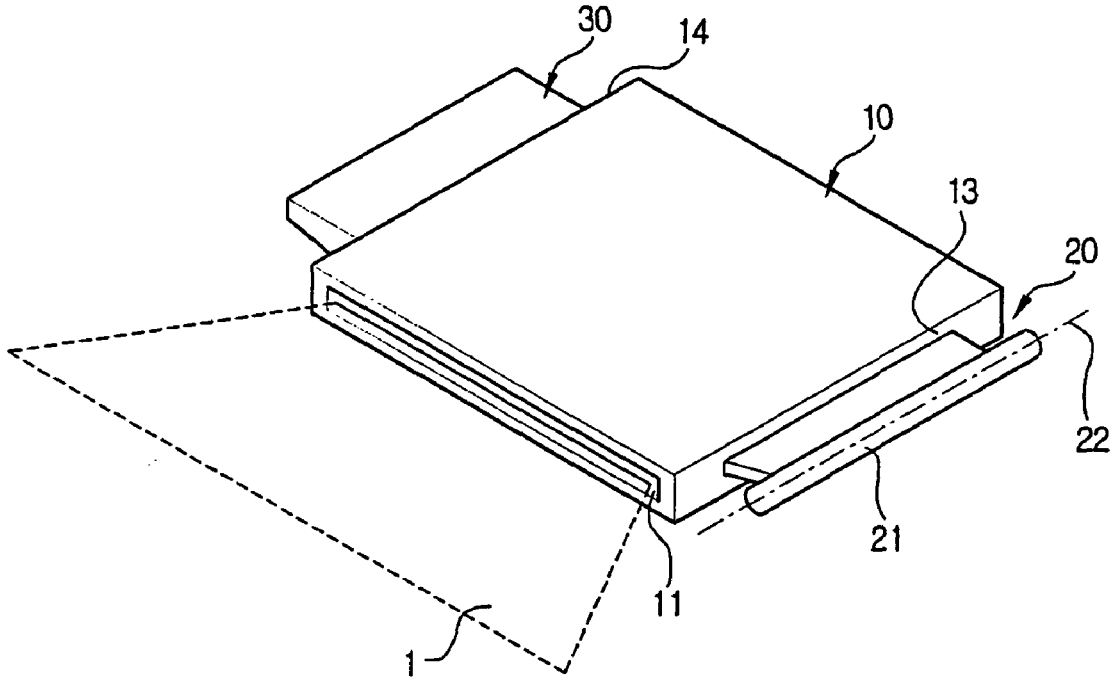
FIG. 1 is a perspective view showing a first embodiment of a laser scan unit assembly according to the present invention.

Reference will now be made in detail to the present preferred embodiments of the present invention, examples of which are illustrated in the accompanying drawings, wherein like reference numerals refer to like elements throughout.

The laser scan unit 10 is an apparatus to scan a laser beam 1, and formed of a unit having a laser light source, a collimator, a cylinder lens, a polygon mirror, an F-θ lens, and a reflector (not shown) that are necessary to scan the laser beam 1. On the front side of the laser scan unit 10, a window 11 is provided to emit the laser beam 1.

Figure 3:
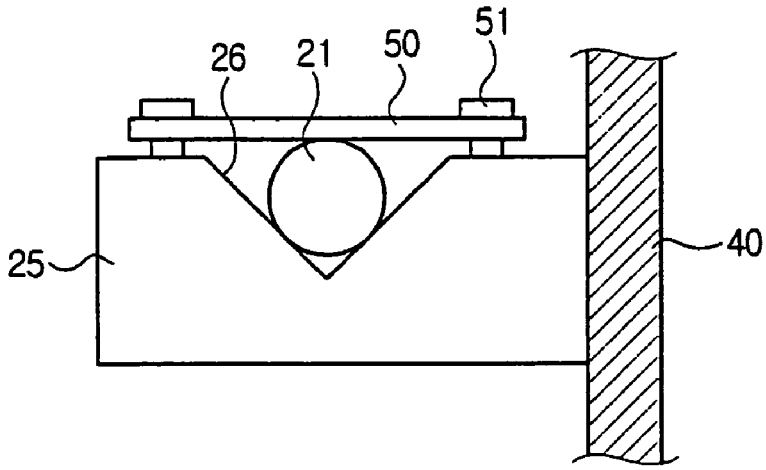
FIG. 3 is a side view showing a resilient member disposed in a hinge portion of FIG. 2.

The hinge portion 20 allows the laser scan unit 10 to pivot with respect to a printer body 40 and provided at one side of the laser scan unit 10. That is, when the part of the laser scan unit 10 with the window 11 is considered as a front side, the hinge portion 20 is provided on one of two sides 13, 14 of the laser scan unit 10. The hinge portion 20 is formed as a hinge shaft 21, as shown in FIG. 1. A rotary shaft 22 of the hinge portion 20 and the laser beam 1 emitted from the window 11 are in the same plane. In addition, a hinge supporting portion 25 is formed on the printer body 40 to which the laser scan unit assembly is disposed to correspond with the hinge portion 20. The hinge supporting portion 25 has a groove 26 to support the hinge portion 20 formed in the shape of the hinge shaft 21. The groove 26 is formed in a V shape. In addition, the hinge shaft 21 is pressed by a resilient member 50 (as shown in FIG. 3) to maintain the hinge shaft 21 and the groove 26 to always stay in contact with each other. The resilient member 50 may use a metal plate having a predetermined resilience and is fastened onto the hinge supporting portion 25 by a plurality of screws 51. The resilience of the resilient member 50 is determined within a range in which the resilient member 50 can maintain the hinge shaft 21 to stay in contact with the groove 26 and at the same time allow the laser scan unit 10 to pivot freely up and down by the adjusting portion 30.

Figure 2:
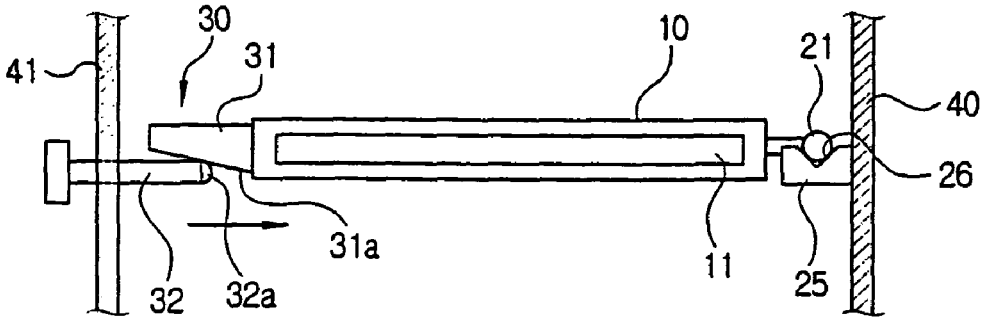
FIG. 2 is a sectional view showing the laser scan unit of FIG. 1, assembled in a printer body.
Figure 4:
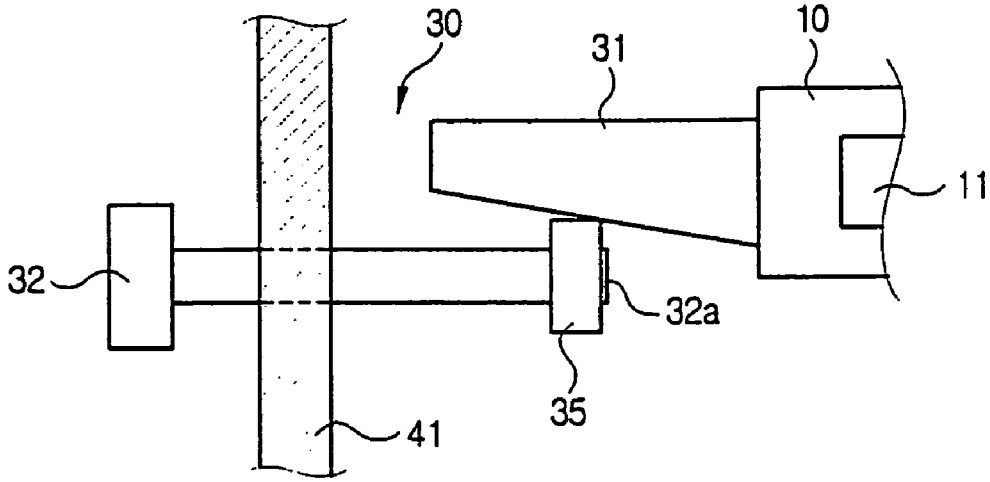
FIG. 4 is a sectional view showing a guiding ring assembled in a screw of FIG. 2.

The adjusting portion 30 adjusts the amount the laser scan unit 10 pivots around the hinge portion 20 and is disposed on the side 14 opposite to the side 13 on which the hinge portion 20 of the laser scan unit 10 is provided. The adjusting portion 30 includes a first adjusting unit 31 disposed on the laser scan unit 10 and a second adjusting unit 31 disposed on the printer body 41. As shown in FIG. 2, the first adjusting unit 31 may be formed as an inclined surface 31*a* and the second adjusting unit 32 is a screw moving forward and backward with respect to the inclined surface 31*a* (hereinafter, the second adjusting unit 32 may also be referred to as the screw 32). When the screw 32 is moved forward (in the direction indicated by the arrow) the laser scan unit 10 pivots upward on the hinge portion 20. When the screw 32 is pulled in the opposite direction of the arrow in FIG. 2, the laser scan unit 10 pivots downward on the hinge portion 20. At this time, the screw 32 has a guiding ring 35 at an end portion 32*a* assembled thereon (as shown in FIG. 4) in order to facilitate contact between the screw 32 and the inclined surface 31*a*.

Figure 5:
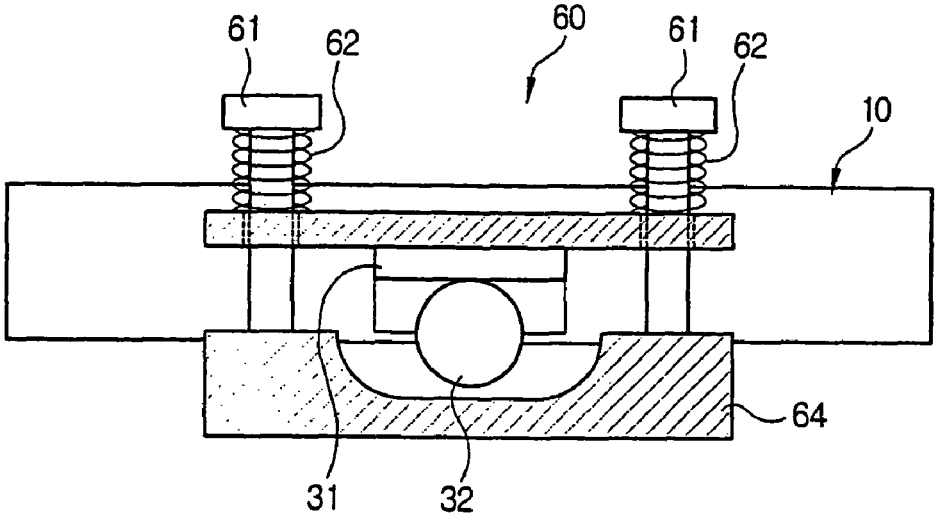
FIG. 5 is a side sectional view showing a pressing unit disposed in an adjusting portion of FIG. 6.

A pressing unit 60 presses the first adjusting unit 31 against the second adjusting unit 32 with a predetermined pressure in order to ensure that the laser scan unit 10 pivots upward and downward by the second adjusting unit 32, as shown in FIG. 5. Referring to FIG. 5, the pressing unit 60 includes a guiding rod 61 fastened on a fastening portion 64 and a spring 62 interposed between the first adjusting unit 31 and the guiding rod 61. The fastening portion 64 guides rectilinear movement of the screw 32 and is disposed on a printer body 41 (FIG. 2) to fasten the guiding rod 61. Therefore, the first adjusting unit 31 presses an end portion 32*a* (FIG. 2) of the screw 32 with a predetermined pressure at all times.

Figure 6:
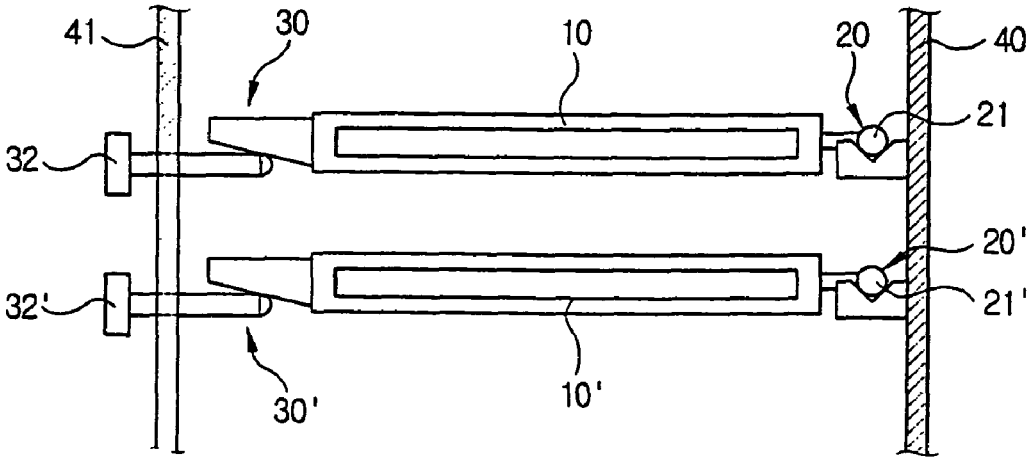
FIG. 6 is a sectional view showing two laser scan unit assemblies of FIG. 1 assembled in a printer body.

Hereinafter, the operation of the laser scan unit assembly structured as above is described. When the end portion 32*a* of the screw 32 is moved forward in the direction indicated by the arrow in FIG. 2 by being turned, the laser scan unit 10 pivots upward on the hinge shaft 21 by the inclined surface 31*a* of the first adjusting unit 31. On the contrary, when the end portion 32*a* of the screw 32 is pulled by turning the screw 32, the laser scan unit 10 pivots downward on the hinge shaft 21 by the inclined surface 31*a*. When two laser scan unit assemblies are disposed on the printer body as shown in FIG. 6, laser beams emitted from the two laser scan units 10, 10' can be adjusted to be parallel with each other by adjusting the adjusting portions 30, 30' of each of the laser scan unit assemblies. That is, the two laser beams can be formed on the photosensitive body (not shown) to be parallel with each other by turning the second adjusting units 32, 32' of each laser scan unit assembly, thereby pivoting the laser scan units 10, 10' upward and downward on the hinge portions 21, 21'.

Figure 7:
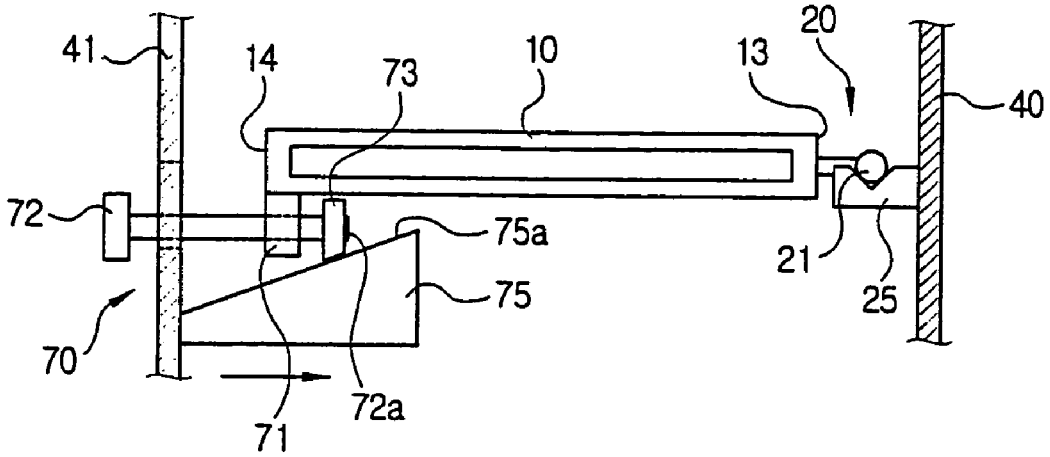
FIG. 7 is a sectional view showing a laser scan unit assembly according to a second embodiment of the present invention assembled in a printer body.

A second embodiment of the laser scan unit assembly according to the present invention is shown in FIG. 7. Referring to FIG. 7, the laser scan unit assembly according to the second embodiment includes the laser scan unit 10 and the hinge portion 20 (as in the first embodiment), and an adjusting portion 70.

The hinge portion 20 pivots the laser scan unit 10 with respect to the printer body 40, and is provided at the side 13 of the laser scan unit 10.

The adjusting portion 70 adjusts the amount the laser scan unit 10 pivots on the hinge portion 20 and is provided on the side 14 opposite to the side 13. The adjusting portion 70 includes a first adjusting unit 72 disposed on the laser scan unit 10 and a second adjusting unit 75 disposed on the printer body 41. As shown in FIG. 7, the first adjusting unit 72 is a screw 72 and the second adjusting unit 75 includes an inclined surface 75*a*. The screw 72 is assembled in a nut portion 71 formed in the laser scan unit 10. The inclined portion 75*a* inclines so that the laser scan unit 10 rises when the screw 72 is moved forward in the direction shown by the arrow in FIG. 7 and is fastened on the printer body 41. Therefore, when the screw 72 is turned to be moved forward, the laser scan unit 10 pivots upward by the inclined surface 75*a* of the second adjusting unit 75. When the screw 72 is moved in the direction opposite to the arrow in FIG. 7, the laser scan unit pivots downward by the inclined surface 75*a* of the second adjusting unit 75*a*. As described in the first embodiment, the guiding ring 73 may be assembled on the end portion 72*a* of the screw in order to facilitate contact between the end portion 72*a* and the inclined surface 75*a*. Also, although not shown in FIG. 7, the pressing unit 60 to press the first adjusting unit 72 against the second adjusting unit 75 with a predetermined pressure may be further provided in order to ensure that the laser scan unit 10 pivots upward and downward by the screw 72.

Figure 8:
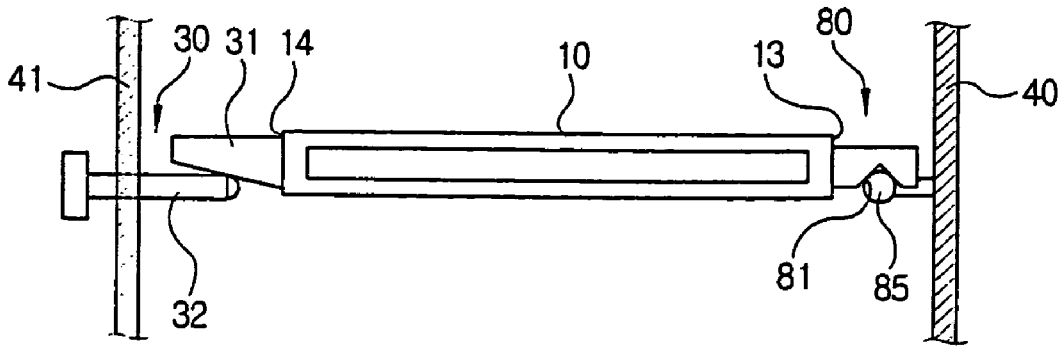
FIG. 8 is a sectional view showing a laser scan unit assembly according to a third embodiment of the present invention assembled in a printer body.

A third embodiment of the laser scan unit assembly according to the present invention is shown in FIG. 8. Referring to FIG. 8, the laser scan unit assembly according to the third embodiment includes the scan unit 10 (as shown in FIG. 1), a hinge portion 80, and an adjusting portion 30.

The hinge portion 80 pivots the laser scan unit 10 on the printer body 40, and is provided on the side 13 of the laser scan unit 10. As shown in FIG. 8, the hinge portion 80 is formed as a groove 81. The supporting portion groove 81 is formed in V shape. In addition, a hinge supporting portion 85 is formed on the printer body 40 to which the laser scan unit assembly is disposed to correspond with the hinge portion 80. The hinge supporting unit 85 is formed as a hinge shaft 80. In addition, a resilient member to press the groove 81 to the hinge shaft 85 may be disposed as in the first embodiment in order to maintain the groove 81 of the hinge portion 80 and the hinge supporting unit 85 to always stay in contact with each other.

The adjusting portion 30 adjusts the amount the laser scan unit 10 pivots around the hinge portion 80, and is disposed on the side 14 opposite to the side 13 on which the hinge portion 80 of the laser scan unit 10 is formed. The adjusting portion 30 is identical to that of the laser scan unit described in the first embodiment and therefore a detailed description is omitted.

Therefore, in the third embodiment, if the screw 32 of the adjusting portion 30 is turned to be moved forward, the laser scan unit 10 pivots upward, but on the contrary, if the screw 32 is turned to be moved backward, the laser scan unit 10 pivots downward, and accordingly, the laser beams can be adjusted to be parallel with each other.

Figure 9:
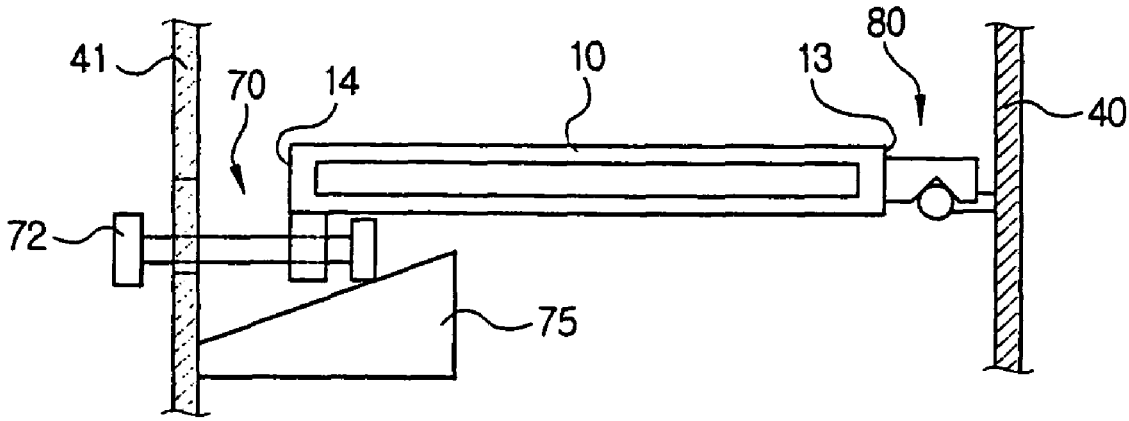
FIG. 9 is a sectional view showing a laser scan unit assembly according to a fourth embodiment of the present invention assembled in a printer body.

FIG. 9 shows the fourth embodiment of the laser scan unit assembly according to the present invention. Referring to FIG. 9, the laser scan unit assembly according to the fourth embodiment includes the laser scan unit 10, the hinge portion 80, and the adjusting portion 70.

The hinge portion 80 pivots the laser scan unit 10 on the printer body 40, and is provided on the side of the laser scan unit 10. The structure of the hinge portion 80 will not be described again as it is identical to that of the third embodiment.

The adjusting portion 70 adjusts the amount the laser scan unit 10 pivots around the hinge portion 80, and is disposed on the side 14 opposite to the side 13 on which the hinge portion 80 of the laser scan unit 10 is formed. The adjusting portion 70 is identical to the laser scan unit in the described second embodiment and therefore a detailed description will be omitted.

Therefore, in the fourth embodiment, if the screw 72 of the adjusting portion 70 is turned to be moved forward, the laser scan unit 10 pivots upward, but on the contrary, if the screw 72 is turned to be moved backward, the laser scan unit 10 pivots downward, and accordingly the laser beams can be adjusted to be parallel with each other.

According to the laser scan unit assembly according to the embodiments of the present invention described above, a plurality of laser beams can be adjusted to be formed on the photosensitive body to be parallel with each other by manually turning the adjusting portion. Accordingly, there is no likelihood of the life span of the laser scan unit being shortened due to temperature increase of the motor, and manufacturing costs may be reduced as there is no need for disposing a motor inside the laser scan unit. In addition, the size of a laser printer may be reduced since no separate space is required for disposing a motor control unit.

What is claimed is:

1. A laser scan unit assembly disposed in a printer body, comprising:

a plurality of laser scan units having a window on a front surface thereof through which laser beams are emitted;

a hinge portion provided at a first side of each of the laser scan units to pivotably dispose the laser scan unit on the printer body; and an adjusting portion on a second side of each of the laser scan units opposite to the first side to adjust an amount the laser scan unit pivots to position the laser beams from the laser scan units to be parallel wherein the adjusting portion comprises:

a first adjusting unit provided on the second side of the laser scan unit, and a second adjusting unit provided on the printer body, wherein the first adjusting unit is an inclined surface and the second adjusting unit is a screw.

2. The laser scan unit assembly according to claim 1, wherein the printer body has a hinge supporting portion provided thereon to support rotation of the hinge portion.

3. The laser scan unit assembly according to claim 2, wherein the hinge portion is a hinge shaft and the hinge supporting portion is a groove to support the hinge shaft.

4. The laser scan unit assembly according to claim 3, wherein the hinge supporting portion further comprises a resilient member to press the hinge shaft against the groove.

5. The laser scan unit assembly according to claim 2, wherein the hinge portion is formed as a groove and the hinge supporting portion is formed as a hinge shaft to support the groove.

6. The laser scan unit assembly according to claim 1, further comprising a guiding ring at an end portion of the screw in contact with the inclined surface.

7. The laser scan unit assembly according to claim 1, wherein the adjusting portion further comprises a pressing unit to press the first adjusting unit against the second adjusting unit.

8. A laser scan unit assembly disposed in a printer body, comprising:

a plurality of laser scan units having a window on a front surface thereof through which laser beams are emitted;

a hinge portion provided at a first side of each of the laser scan units to pivotably dispose the laser scan unit on the printer body; and an adjusting portion on a second side of each of the laser scan units opposite to the first side to adjust an amount the laser scan unit pivots to position the laser beams from the laser scan units to be parallel, wherein the adjusting portion comprises:

a first adjusting unit provided on the second side of the laser scan unit, and a second adjusting unit provided on the printer body, wherein the first adjusting unit is a screw and the second adjusting unit is an inclined surface.

9. A laser printer forming an image using a plurality of laser beams, the laser printer comprising:

a printer body;

a photosensitive body on which an image is formed by the plurality of laser beams;

a developing apparatus to develop the image formed on the photosensitive body and to transfer the developed image onto a paper;

a paper convey apparatus to convey the paper to the developing apparatus; and a plurality of laser scan unit assemblies, each comprising:

a laser scan unit comprising a window on a front surface thereof through which the laser beam is emitted, a hinge portion provided at a first side of the laser scan unit to pivotably dispose the laser scan unit, and an adjusting portion provided on a second side of the laser scan unit opposite to the first side to adjust an amount the laser scan unit pivots, wherein distances between the plurality of laser beams are adjusted by the adjusting portions to position laser beams from the laser scan units to be parallel, wherein the printer body supports the hinge portions, wherein each adjusting portion comprises:

a first adjusting unit provided on the second side of the laser scan unit, and a second adjusting unit provided on the printer body wherein each first adjusting unit is an inclined surface and each second adjusting unit is a screw.

10. The laser printer according to claim 9, wherein the printer body comprises a plurality of hinge supporting portions provided thereon to support rotation of the hinge portions, respectively.

11. The laser printer according to claim 10, wherein each hinge portion is formed as a hinge shaft and each hinge supporting portion is formed as a groove to support the respective hinge shaft.

12. The laser printer according to claim 11, wherein each hinge supporting portion further comprises a resilient member to press the respective hinge shaft against the groove.

13. The laser printer according to claim 12, wherein the resilient members are metal plates having a resilience.

14. The laser printer according to claim 11, wherein the laser beams and the respective hinge shafts are formed in a same plane.

15. The laser printer according to claim 11, wherein the grooves have a V-shape.

16. The laser printer according to claim 10, wherein each hinge portion is formed as a groove, and each hinge supporting portion is formed as a hinge shaft supporting the respective groove.

17. The laser printer according to claim 9, further comprising guiding rings assembled at end portions of the screws, wherein the guiding rings contact the inclined surfaces.

18. The laser printer according to claim 9, wherein each adjusting portion further comprises a pressing unit to press the respective first adjusting unit against the respective second adjusting unit.

19. The laser printer according to claim 18, wherein the pressing units each comprise:

a fastening portion;

a guiding rod fastened on the fastening portion; and a spring between the first adjusting unit and the guiding rod.

20. A laser printer forming an image using a plurality of laser beams, the laser printer comprising:

a photosensitive body on which an image is formed by the plurality of laser beams;

a developing apparatus to develop the image formed on the photosensitive body and to transfer the developed image onto a paper;

a paper convey apparatus to convey the paper to the developing apparatus;

a plurality of laser scan unit assemblies, each comprising:

a laser scan unit comprising a window on a front surface thereof through which the laser beam is emitted, a hinge portion provided at a first side of the laser scan unit to pivotably dispose the laser scan unit, and an adjusting portion provided on a second side of the laser scan unit opposite to the first side to adjust an amount the laser scan unit pivots, wherein distances between the plurality of laser beams are adjusted by the adjusting portions to position laser beams from the laser scan units to be parallel, and a printer body to support the hinge portions, wherein each adjusting portion comprises:

a first adjusting unit provided on the second side of the laser scan unit, and a second adjusting unit provided on the printer body, wherein each first adjusting unit is a screw and each second adjusting unit is an inclined surface.

21. An apparatus, comprising:

a scan unit to emit a laser beam;

a hinge to pivotably support the scan unit; and an adjusting portion to adjust an amount of pivot of the hinge, wherein the adjusting portion includes a screw and an inclined surface in contact with the screw, wherein a linear movement of the screw across the inclined surface pivots the scan unit.

22. The apparatus according to claim 21, wherein the hinge and the adjusting portion are on opposite sides of the scan unit.

23. The apparatus according to claim 21, wherein the adjusting portion further comprises a nut to support the screw and formed on the scan unit.

24. The apparatus according to claim 21, further comprising a support to support the hinge.

25. The apparatus according to claim 24, wherein the hinge is a V-shaped groove and the support is a shaft.

26. The apparatus according to claim 24, wherein the support is a V-shaped groove and the hinge is a shaft.

27. An apparatus, comprising:

a scan unit to emit a laser beam;

a hinge to pivotably support the scan unit; and an adjusting portion to adjust an amount of pivot of the hinge, wherein the adjusting portion includes a screw and an inclined surface in contact with the screw, wherein a linear movement of the screw across the inclined surface pivots the scan unit, and the inclined surface is attached to the scan unit.

28. An image forming apparatus, comprising:

a body; and a scan unit assembly disposed within the body, comprising:

a scan unit to emit a laser beam, a hinge portion to pivotably support the scan unit, and an adjusting portion to adjust an amount of pivot of the hinge portion wherein the adjusting portion includes a screw and an inclined surface in contact with the screw, wherein a linear movement of the screw across the inclined surface pivots the scan unit.

29. A subassembly of a laser scan unit, comprising:

a hinge portion provided at a first side of the laser scan unit to pivotably dispose the laser scan unit on a printer body, wherein the hinge portion is formed as a groove;

a hinge supporting portion supporting the groove; and an adjusting portion on a second side of the laser scan unit opposite to the first side to adjust an amount by which the laser scan unit pivots, wherein the adjusting portion includes a screw and an inclined surface in contact with the screw.

* * * * *